US005926896A

United States Patent [19]

Allemann et al.

[11] Patent Number: 5,926,896

[45] Date of Patent: Jul. 27, 1999

[54] COLLAPSIBLE CLEANING IMPLEMENT

[75] Inventors: Max Allemann, Utzenstorf; Beat Allemann, Wiler b. U., both of Switzerland

[73] Assignee: Rubbermaid Commercial Products LLC, Winchester, Va.

[21] Appl. No.: 08/977,905

[22] Filed: Nov. 25, 1997

[51] Int. Cl.[6] ..... A47L 13/258

[52] U.S. Cl. ..... 15/147.2; 15/147.1; 15/228; 15/229.6; 15/229.8; 15/231

[58] Field of Search ..... 15/147.1, 147.2, 15/150, 228, 229.1–229.9, 231–233; 451/354, 523, 524

[56] References Cited

U.S. PATENT DOCUMENTS

| | | | |
|---|---|---|---|
| 1,256,989 | 2/1918 | Duncan | 15/228 |
| 1,344,936 | 6/1920 | Beaudet | 15/228 |
| 2,840,840 | 7/1958 | Yamen | 15/147.1 |
| 2,975,451 | 3/1961 | McPherson | 15/147.2 |
| 3,005,220 | 10/1961 | McPherson | 15/147.2 |
| 3,300,804 | 1/1967 | Benjamin | 15/147.2 |
| 3,324,495 | 6/1967 | Van Schwartz | 15/147.2 |
| 3,405,418 | 10/1968 | Carter et al. | 15/147.1 |
| 3,458,886 | 8/1969 | Goettel . | |
| 4,663,798 | 5/1987 | Sacks et al. | 15/261 |
| 4,704,763 | 11/1987 | Sacks et al. | 15/262 |
| 4,783,873 | 11/1988 | Young | 15/147.2 |
| 4,799,283 | 1/1989 | Haydon | 15/229.1 |
| 4,843,674 | 7/1989 | Jones | 15/147.1 |
| 4,881,290 | 11/1989 | Bohacek | 15/228 |
| 4,893,369 | 1/1990 | Johnson | 15/119.2 |
| 4,991,250 | 2/1991 | Young | 15/228 |
| 5,218,734 | 6/1993 | Sacks | 15/147.2 |

FOREIGN PATENT DOCUMENTS

| | | | |
|---|---|---|---|
| 461684 | 12/1991 | European Pat. Off. . | |
| 3808310 | 9/1989 | Germany | 15/229.1 |
| 3923859 | 2/1990 | Germany . | |
| 6910563 | 4/1995 | Germany . | |
| 6901692 | 6/1995 | Germany . | |
| 5-7543 | 1/1993 | Japan | 15/147.1 |
| 2206037 | 12/1988 | United Kingdom . | |
| 94/09692 | 5/1994 | WIPO | 15/228 |

*Primary Examiner*—Mark Spisich
*Attorney, Agent, or Firm*—Richard B. O'Planick; Timothy A. Nathan

[57] ABSTRACT

A cleaning implement (1) wherein the plate-like carrier (2) for a mophead (6) has a centrally located plate-like support (7) which overlaps the upper surfaces of inner portions of two plate-like sections (9, 9*a*) having outer portions (5) with devices for releasably clamping flaps (33) at the ends of a mophead. Alternatively, the plate-like sections (9, 9*a*) may be used to secure a mophead (6) having pockets (100, 110*a*). The sections of the carrier (2) are held in a first position (in which their lower surfaces are substantially coplanar and the median portion of the mophead is stretched along the lower surfaces of the sections) by a single locking bolt (14) which is reciprocable in a guide (13) at the upper side of the support (7). The guide (13) defines a pivot axis for the lower end of a handle (4), and the sections (9, 9*a*) are pivotable about two neighboring axes which are normal to the pivot axis for the handle (4). The locking bolt (14) is selectively releasable into one of two configurations. In a second, collapsed, position, the sections (9, 9*a*) are substantially confronting. In a third, semi-collapsed, position, the sections (9, 9*a*) are retained at an angle between the first position and the second position. The locking bolt (14) is automatically locked in the first position when the sections (9, 9*a*) of the carrier (2) are pivoted back to a coplanar position from either the second position or the third position.

18 Claims, 5 Drawing Sheets

COLLAPSIBLE CLEANING IMPLEMENT

BACKGROUND OF THE INVENTION

1. Field of Invention

The invention relates to cleaning implements in general, and more particularly to improvements in cleaning implements of the type known as mops. Still more particularly, the invention relates to improvements in cleaning implements of the type wherein the carrier for the mophead is collapsible.

2. Decsription of the Prior Art

It is well known in the art that cleaning implements may employ detachable mopheads having a carrier comprising two plate-like sections. Commonly, the sections are pivotable between first positions in which their lower surfaces are substantially coplanar and second positions in which their lower surfaces confront each other. The upper side of the carrier pivotably supports one end of an elongated handle, and the mophead is releasably connected to the outer portions of the sections so that it can be caused to hang downwardly beyond the sections in the second positions of such sections and to be more readily introduced into a supply of cleaning liquid or into a suitable wringer.

Other cleaning implements disclose attaching the mopheads to the carriers with a pair of pockets where each pocket receives one of the sections. In this arrangement, the mophead is attached in a way that it is located between the confronting lower surfaces of the sections when the sections are caused or permitted to assume their second positions. Thus, the sections are supposed to act not unlike a wringer which is to expel moisture from the mophead between them.

Generally, conventional cleaning implements of the above outlined character are provided with locking devices which can releasably hold the sections of the mophead carrier in their first or operative positions. In this arrangement, the locking devices are engaged or activated in response to exertion of requisite pressure upon the handle in a direction toward the upper side of the carrier while the mophead lies on the floor or on another support. The locking devices for both sections of the mophead carrier can be disengaged or deactivated in response to an abrupt pull upon the handle or by pulling the handle while a foot presses the section to be unlocked against the floor.

It has been found that the above described manipulation of cleaning implements with a collapsible mophead carrier is rather unreliable. For example, the locking device for the one and/or the other section of the carrier may be undesirably released or disengaged when the implement is caused to strike an elevation in the floor which is to be cleaned such as when the carrier strikes a stair. Thus, the operator in charge of manipulating a conventional mop must be on alert at all times in order to immediately ascertain whether or not the one or the other section of the mophead carrier has become unlocked and is free to leave its operative position. This, in turn, interferes with the cleaning operation and renders such operation less reliable since the operator must exercise extreme care to prevent the mop from striking an obstruction on the floor. Accordingly, one skilled in the art can best recognize that the locking devices for the pivotable sections are likely to become deactivated at an inopportune time. Each unintentional deactivation of a locking device necessitates an interruption of the cleaning operation which is particularly undesirable when a mop is used to clean a relatively large surface and the operator is expected to complete the cleaning operation within a certain interval of time.

Proposals to enhance the locking action of heretofore known locking devices have met with limited success. The locking force cannot be increased at will because this would necessitate a corresponding increase of the unlocking force. The unlocking force must be applied at certain intervals in order to replace a damaged (particularly worn) mophead or to permit thorough cleaning and subsequent wringing of the mophead. Moreover, if the implement is used to sweep solid impurities, the need for an increased pull in order to unlock the devices which hold the sections of the carrier in operative positions is likely to cause the accumulated solid impurities to fall off the mophead.

A somewhat greater locking force can be applied if the locking devices for the sections of the mophead carrier are disengaged one after the other. This involves the pressing of one section against the floor while the handle is pulled upwardly and away from the floor, and thereupon holding the other section against the floor while the pulling action upon the handle is repeated. This is a time-consuming operation which can affect the output of the user of such cleaning implements.

To overcome the disadvantages of the above cleaning implements, various other cleaning implements have been proposed. One such cleaning implement is disclosed in U.S. Pat. No. 5,218,734 to Sacks. Sacks teaches a cleaning implement that has two panels pivotably connected by a support. The panels are pivotable between first positions, where the panels are substantially coplanar, and second positions, where the panels are substantially confronting. A single actuator is provided which locks the panels in the first position.

As best appreciated by one skilled in the art, the cleaning implement to Sacks allows the user to unlock the panels from the first position to the second position by operating a single actuator. Also, the device to Sacks allows the user to unlock the device without operation by the user's hands. Instead, the actuator to Sacks is conveniently located so that it can be operated by the user's foot.

The device to Sacks substantially advances the art; yet, further improvements would be desirable. Although unlocking both panels is an improvement over conventional cleaning implements, this arrangement may be further improved. For instance, when the device to Sacks is used with mopheads having pockets that fit over each section, it becomes an awkward and time consuming maneuver to insert each section into a respective pocket. In the first position, the mophead is brought into a taut position and thus secured in place over the sections. In the second position, the panels are substantially coplanar. When in the second position, easy access to the mophead is substantially frustrated since the mophead is trapped between the confronting sections. Also, attaching a new mophead to the cleaning implement is substantially difficult and requires a great deal of contact between the operator and the cleaning implement. Contact between the operator and the cleaning implement is undesirable and unsanitary since cleaning implements often become soiled over time with use.

Accordingly, as can be seen from above, it would be desirable to have a cleaning implement that can be efficiently used with mopheads that are attached by pockets as well as with mopheads that are attached by flaps at the end portions of each of the sections. Further, it would also be desirable to have a cleaning implement where mopheads can be attached with minimal contact between the operator and the mophead.

SUMMARY OF THE INVENTION

A first object of the invention is to provide a cleaning implement that can be collapsed, semi-collapsed and erected in a simple and time saving manner. Another object of the invention is to provide a cleaning implement wherein both sections of the carrier can be released for movement to a collapsed position in response to the actuation of a single releasing device.

A further object of the invention is to provide a cleaning implement wherein one section of the carrier can be released for movement to a semi-collapsed position in response to the actuation of a single releasing device.

An additional object of the invention is to provide a single releasing device that a user can actuate without bending by the operator.

Still another object of the invention is to provide a cleaning implement with a novel and improved mechanism for selecting whether the single releasing device releases to a collapsed position or a semi-collapsed position.

In accordance with a preferred embodiment of the this invention, these and other objects and advantages are accomplished as follows.

The invention is embodied in a collapsible cleaning implement of the type commonly known as a mop. However, the novel aspects of this invention may be utilized with other similar cleaning implements. The improved cleaning implement of this invention comprises a carrier including first and second sections or panels each having an upper surface and a lower surface. The sections are pivotable relative to each other between a first position in which the lower surfaces of the two sections are substantially coplanar, a second position in which the lower surfaces substantially confront each other, and a third position in which the panels are retained in a position between the first position and the second position. The implement further includes a mechanism for releasably locking the sections in the first position. This mechanism includes a locking device that is actuatable such that the sections are retained in a first position where both of the end portions of the locking device are secured inside respective sockets on the carrier, a second position where both of the end portions are released from the sockets, and a third position where only one of the end portions is released from its respective socket. Finally, one novel aspect of this invention is that the cleaning implement also includes a selection mechanism that cooperates with the locking device. The selection mechanism has two orientations. The first orientation allows the sections to enter the third position once actuated. The second orientation of the selection mechanism allows the sections to enter the second position. Accordingly, the user may choose whether the cleaning implement moves to the second, collapsed, position or to the third, semi-collapsed, position.

In use, the collapsible cleaning implement can be collapsed by releasably locking the cleaning implement. The collapsible cleaning implement may achieve the second position where the sections are substantially confronting or a third position with the sections are retained between the first position and the second position. If the operator desires for the cleaning implement to enter the second position, the operator must perform only two steps. First, the operator must ensure that the selection mechanism is set to the second orientation. Next, the user must actuate the locking device. Once done, the sections are pivotable to a substantially coplanar position. However, if it is desired for the cleaning implement to enter the third position, the operator will once again need to follow a two step process. First, the operator must verify that the selection mechanism is set to the first orientation. Next, the user must actuate the locking device. Once done, the sections are pivotable to the third position which is between said first position and said second position.

One advantage of the above invention is that the user can more easily use this leaning implement with mopheads that are attached by pockets to the carrier. When the user sets the selection mechanism for the first position, the user has sufficient slack to remove the previous mophead, if any. Next, the user can attach a new mophead by laying the mophead on the floor with the pockets facing upward relative to the ground. The user can then place the carrier over the mophead with the sections retained at an angle. Then, as the carrier is forced down on top of the mophead, each section is caught by its respective pocket and then is slid along the pocket until both sections are locked into the first position. As can be best appreciated by one skilled in the art, the second position is not capable of providing a similar attachment process. The sections when in the second position are substantially confronting and extend downward when the carrier is suspended above the ground. As such, pressure applied to the carrier would be transferred along a longitudinal axis of the carrier thus providing insufficient force tangential to the ground. Accordingly, the sections would not slide into the pockets of the mophead.

Another advantage of the above disclosed invention is that the cleaning implement of this invention allows the user to select which orientation the user desires. When in the first orientation, the sections will be released into the third, semi-collapsed, position. When in the second orientation, the sections will be released into the second, collapsed, position. Accordingly, the above disclosed invention provides additional versatility over other conventional cleaning implements. With each successive actuation, the same position (second position, third position) is achieved until the user sets the selection mechanism to either the first orientation or the second orientation.

Still another advantage of this invention is that the user can release the collapsible cleaning implement into either the second position or the first position by operation of a single actuator. Advantageously, the user does not have to operate several different mechanisms to release the sections of the cleaning implement.

The novel features which are considered as characteristic of the invention are set forth in particular in the appended claims. The improved cleaning implement itself, however, both as to its construction and its mode of operation, together with additional features and advantages thereof, will be best understood upon review of the following detailed description of certain presently preferred specific embodiments with reference to the accompanying drawings.

BRIEF DESCRIPTION OF THE DRAWINGS

The above and other advantages of this invention will become more apparent from the following description taken in conjunction with the accompanying drawings, in which.

DETAILED DESCRIPTION OF THE PREFERRED EMBODIMENT

Figure 1:
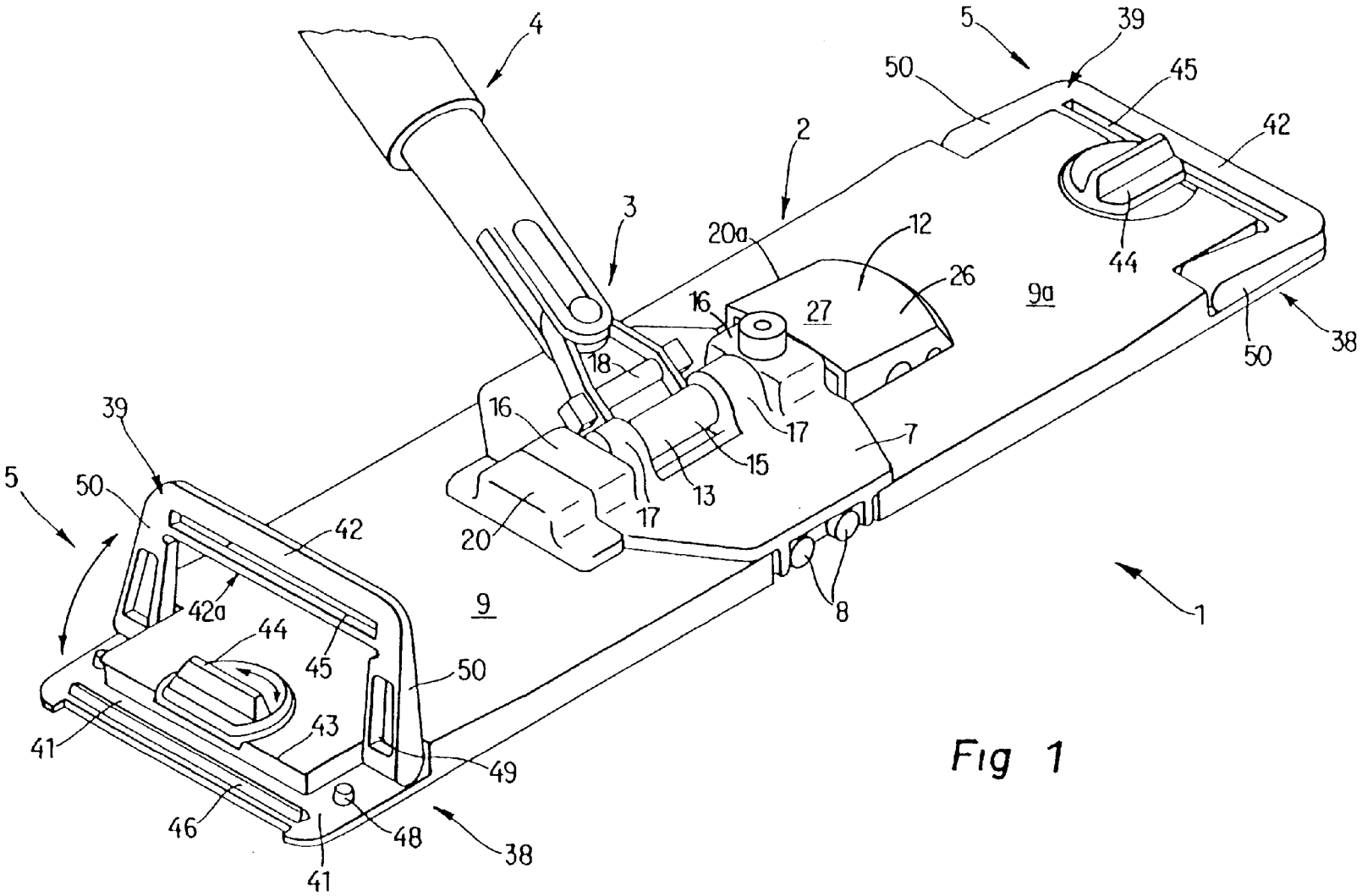
FIG. 1 is a perspective view of a collapsible cleaning implement which embodies one form of the invention the plate-like sections of a carrier for a mophead being shown in a first, operative, position and one yoke of the means for separably connecting the mophead to the sections being shown in the releasing position, the mophead being omitted for the sake of clarity.

A cleaning implement is provided that can be retained in a first (operative) position a second (collapsed) position and a third (semi-collapsed) position. With particular reference to FIG. 1, there is shown a collapsible cleaning implement 1 (hereinafter mop) which comprises a substantially rectangular elongated plate-like carrier 2 for a mophead 6, a handle 4, and a means 3 for pivotably coupling one end portion of the handle 4 to the carrier 2.

Figure 6:
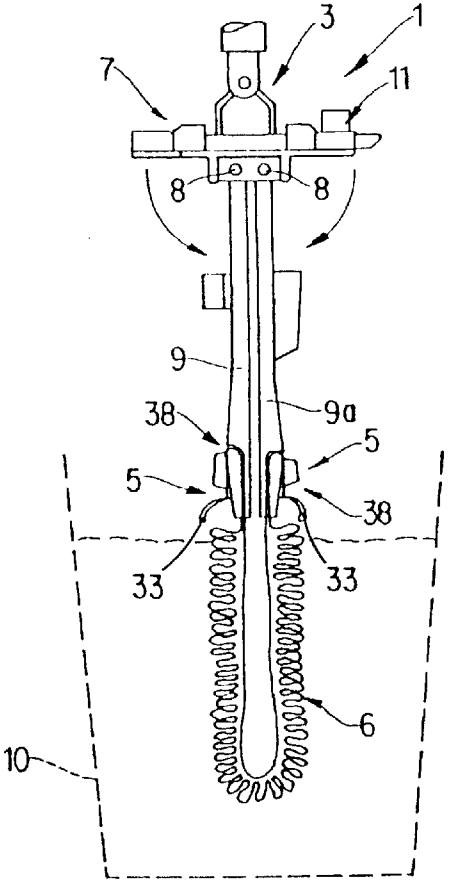
FIG. 6 is a side elevational view of the cleaning implement with the sections moved to their second positions and with the central portion of the mophead immersed into a supply of cleaning liquid in a vessel which is indicated by broken lines.

In one embodiment, the mophead 6 is positively but separably connected only to the outer portions 5 of two plate-like sections or panels 9, 9*a* of the carrier 2 in such a way that the median portion of the mophead 6 hangs downwardly in the form of a loop, as seen in FIG. 6, when the sections 9, 9*a* are permitted to move from a first position (in which their lower surfaces are disposed in or close to a common plane) to either a second position (in which their lower surfaces are adjacent and confront each other) or a third position (in which their lower surfaces are angularly disposed a distance apart relative to each other). In another embodiment, the mophead 6 is retained to the carrier 2 by a pair of pockets 100, 100*a* on the mophead 6 as shown in FIG. 5.

More specifically, the carrier 2 comprises a central section or support 7 which mounts the coupling mechanism 3 for the handle 4 to the carrier 2. Further, the support 7 carries two hinges including parallel pintles 8 serving to pivotably connect the sections 9, 9*a* to the support 7. The support overlies the adjacent portions of the upper surfaces of sections 9, 9*a* when the mop 1 is ready for use. In the first position, the sections 9, 9*a* are substantially coplanar and the mophead 6 is stretched to overlie the lower surfaces of both sections 9, 9*a*. The axes of the two sets of pintles 8 are parallel to each other, and the distance between such axes preferably exceeds the thickness of the section 9 or 9*a*. For example, the distance between the parallel axes of the two sets of pintles 8 can equal or approximate the combined thickness of the sections 9 and 9*a*, i.e., twice the thickness of the section 9 or 9*a* (it being assumed here that the sections 9 and 9*a* are substantially identical).

When the sections 9, 9*a* are caused or permitted to assume the second position, as shown in FIG. 6, the downwardly extending major portion of the mophead 6 (between the then neighboring outer portions 5 of the sections 9 and 9*a*) can be readily introduced into a relatively small vessel 10 which is indicated in FIG. 6 by broken lines and contains a supply of clean water or another suitable cleaning liquid. When the sections 9, 9*a* are in the third position, the sections 9, 9*a* are angularly disposed a distance apart. In a preferred embodiment, this is achieved by releasing only one of the sections, section 9*a* in FIG. 4, and retaining one of the sections, section 9 in FIG. 4. In either the third position or in the second position, the sections 9, 9*a* are automatically retained in the first position once the sections 9, 9*a* are substantially coplanar.

Figure 2:
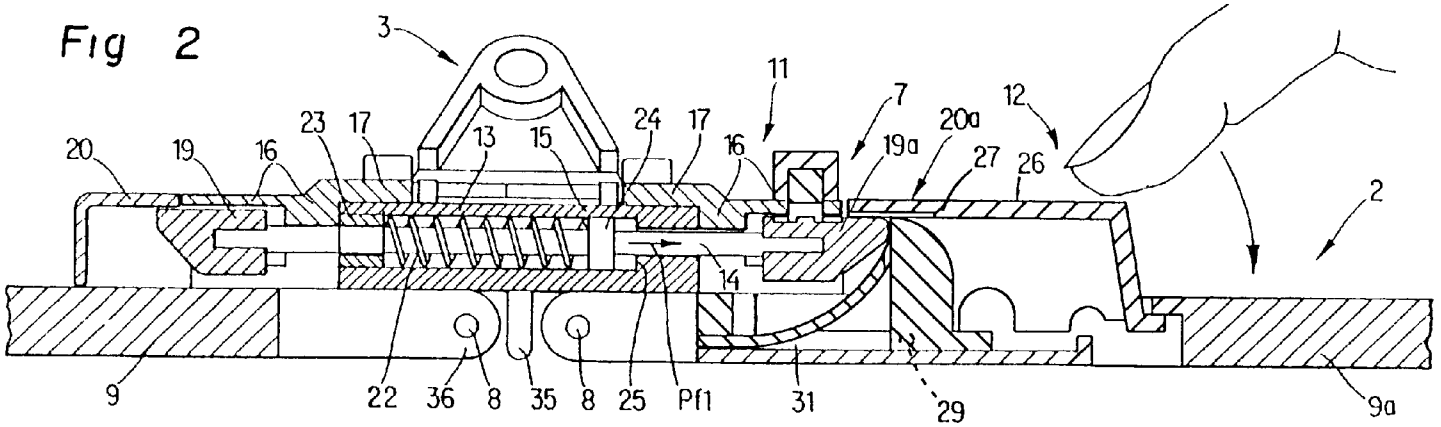
FIG. 2 is a fragmentary central longitudinal sectional view of the cleaning implement, with the sections of the carrier shown locked in the first position.
Figure 3:
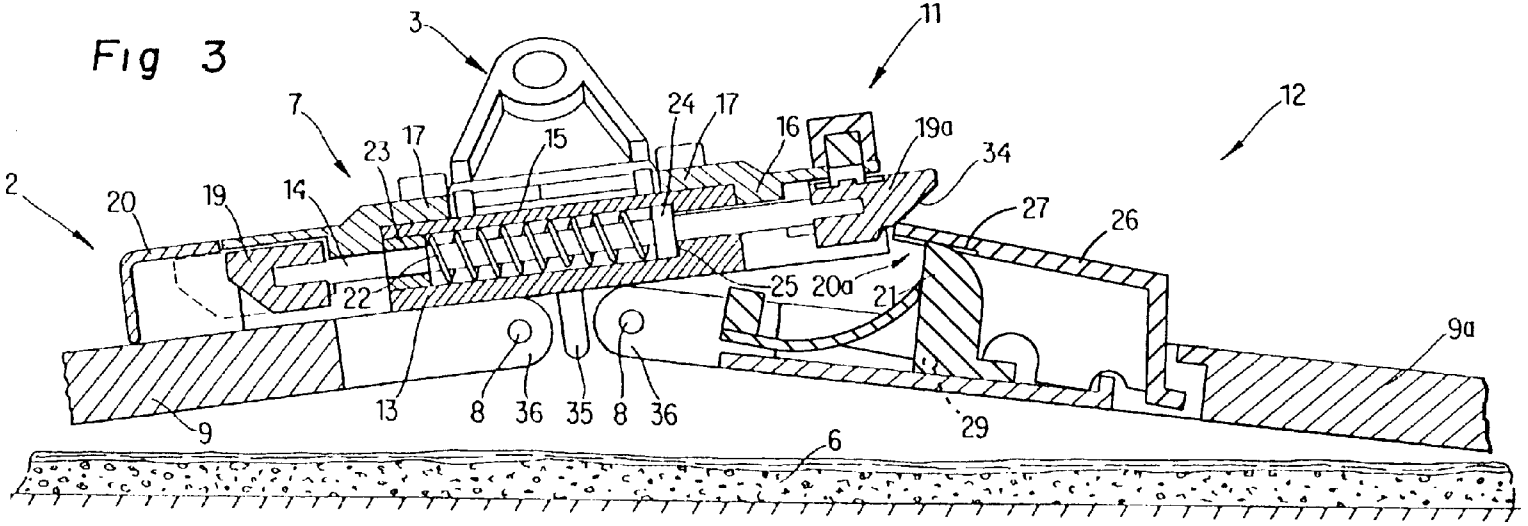
FIG. 3 is a similar fragmentary central longitudinal sectional view of the cleaning implement after being actuated to move into the second position.
Figure 4:
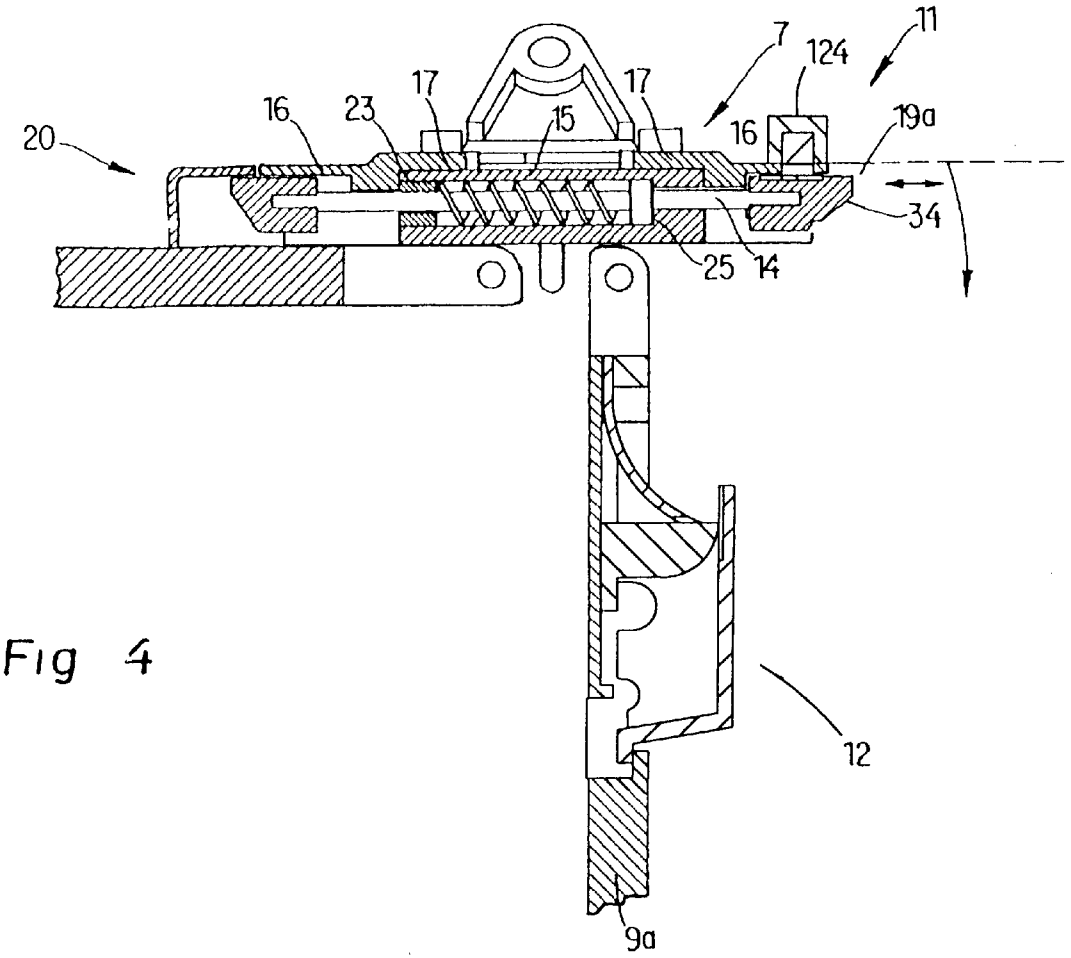
FIG. 4 is a similar fragmentary central longitudinal vertical sectional view showing the cleaning implement in the third position with one of the sections released and the other section retained.
Figure 5:
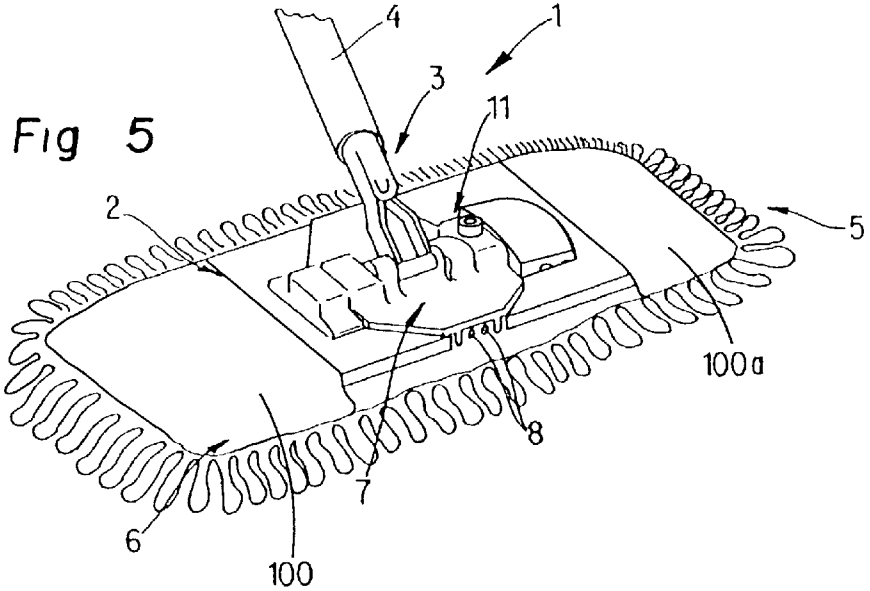
FIG. 5 is a perspective view of the cleaning implement, with a portion of the handle broken away and with the mophead connected to the sections with pockets on the mophead.

A locking device 11 for the sections 9 and 9*a* of the carrier 2 is mounted at the upper side of a support 7 and remains operative to prevent pivoting of the sections 9, 9*a* about the axis of the respective sets of pintles 8 until and unless the operator decides to directly or indirectly operate an actuator 12 which is mounted at the upper surface of the section 9*a* and then permits the sections 9, 9*a* to leave the positions which are shown in FIGS. 1 and 5. More specifically, the locking device 11 includes an elongated locking bolt 14 which is reciprocable in a sleeve or trough-shaped guide 13 of the support 7 and extends transversely of the pivot axes of the sections 9 and 9*a*. The details of the locking bolt 14, guide 13 and actuator 12 are shown in FIGS. 2 and 3. In particular, FIG. 2 shows the locking bolt 14 in the first position in which the sections 9, 9*a* of the carrier 2 are engaged by both sections 9 and 9*a*; FIG. 3 shows the locking bolt 14 in a second position where the locking bolt 14 in a second position disengaged from both sections 9 and 9*a*; and FIG. 4 shows the locking bolt 14 in the third position where the locking bolt 14 is engaged with one section 9 and released from the other section 9*a*. The guide 13 performs an additional important function, namely to define a pivot axis for the handle 4. Such pivot axis is normal to the pivot axes for the sections 9 and 9*a* Thus, the central portion 15 of the guide 13 can be said to form part of the coupling means 3 for the handle 4.

The guide 13 extends between two raised bearing portions 16 which are integral with and disposed at the lateral edges of the support 7 (see particularly FIG. 1). The support 7 can be said to resemble a plate and has bearing members 17 for the guide 13. In the embodiment which is shown in FIG. 1, the bearing members 17 and the raised bearing portions 16 are integral parts of the support 7 and can be made of a suitable metallic or plastic material. The guide 13 is inserted into the bearing members 17 from below at the underside of the support 7 which is exposed (open) between the sections 9, 9*a* as well as between the inner portions of these sections 9, 9*a* (the inner portions are connected to the respective sets of pintles 8). Once the guide 13 is properly installed in the bearing members 17 of the support 7, it is held in such position by a retaining pin or post 18. In addition, the guide 13 is held in place by the inner portion of the sections 9 and 9*a* as soon as these sections are pivotably connected to the support by the pintles 8.

FIG. 2 shows the locking bolt 14 in the first position in which its end portions 19 and 19*a* respectively extend into hood-shaped sockets 20 and 20*a*. The socket 20 is provided at the upper surface of the section 9, and the socket 20*a* is located at the upper surface of the section 9*a* but is provided on the actuator 12. The sockets 20 and 20*a* are spaced apart from the respective pivot axes (i.e., from the respective sets of pintles 8) for the sections 9 and 9*a*. A coil spring 22 serves as a means for biasing the locking bolt 14 to the second or inoperative position of FIG. 3 (arrow Pfl in FIG. 2); this spring 22 reacts against a ring 23 in the guide 13 and bears against a collar 24 of the bolt 14 to urge the collar 24 against an internal shoulder 25 of the guide 13. The shoulder 25 cooperates with the collar 24 to constitute a means for blocking the movement of the locking bolt 14 beyond the inoperative position of FIG. 3 under the action of the spring 22.

The reference character 21 denotes a stop which is provided on the section 9*a* and serves to locate the locking bolt 14 in the first position of FIG. 2, i.e., to prevent the spring 22 from dissipating energy and propelling the locking bolt 14 to the second or inoperative position of FIG. 3. The stop 21 can be engaged by the end portion 19*a* of the locking bolt 14.

The actuator 12 includes a pivotable pedal 26 and a claw 27 which forms part of or constitutes the socket 20*a* and normally overlies the stop 21. The pedal 26 is adapted to be depressed by a finger (see FIG. 2), by an article of footwear or by any other object whereby the pedal 26 pivots about the axis of a hinge 29 which is provided in a recess in the upper surface of the section 9*a* and defines a pivot axis extending in parallelism with the axes of the pintles 8 of hinges for the sections 9 and 9*a*. The hinge 29 is spaced apart from the claw 27 and is provided on a leaf spring 31 which is an integral part of the actuator 12 and serves as a means for pivoting the section 9*a* from the first position of FIG. 2 when the pedal 26 is depressed to pivot the actuator 12 in a clockwise direction (as seen in FIG. 2). The leaf spring 31 integrally formed with the pedal 26 then urges the end portion 19*a* of the locking bolt 14 upwardly and causes it to slide along and to rise above the stop 21 as soon as the claw 27 is moved out of the way in response to pivoting of the actuator 12. The integral leaf spring 31 of the actuator 12 is designed to bear against the underside of adjacent portion of the support 7 when the actuator 12 is pivoted in a clockwise direction (starting from the angular position of FIG. 2).

FIG. 2 shows the pedal 26 about to be depressed by a finger. At such time, the carrier 2 is or can be lifted off the floor to provide room for pivoting of the section 9*a* from the operative or first position of FIG. 2 to the second position of FIG. 3 in which the claw 27 is spaced apart from the tip of the end portion 19*a* and abuts a cam face 34 at the underside of the end portion 19*a*. The cam face 34 serves as or forms part of a means for moving the locking bolt 14 back toward the first position of FIG. 2. The pedal 26 can be depressed by a foot (and more particularly by an article of footwear) or by any other object which is available to pivot the claw 27 from the position of FIG. 2. The pedal 26 is preferably located slightly to the right of claw 27 so that it can be conveniently engaged by an article of footwear while the person in charge is holding on to the handle 4 to maintain the carrier 2 in a position at a level at least slightly above the floor.

However, it is equally possible to start the pivotal movement of the section 9*a* from the first position of FIG. 1 without lifting the carrier 2 above the floor. Thus, the operator steps onto the pedal 26 while the sections 9 and 9*a* are locked in the first position. The pedal 26 causes the claw 27 to move away from the end portion 19*a* of the locking bolt 14 and the leaf spring 31 causes the section 9*a* to pivot clockwise relative to the section 9 and support 7. This suffices to move the end portion 19*a* of the locking bolt 14 along the adjacent side of and above the stop 21 on the section 9*a*. In the first embodiment of the selection mechanism, the spring 22 is free to expand and to propel the collar 24 of the locking bolt 14 against the shoulder 25 so that the end portion 19 is withdrawn from the socket 20 and the section 9 is free to pivot relative to the support 7 (see FIG. 4).

In order to return the sections 9, 9*a* to the first position, the outer portions 5 of such sections are caused to (indirectly) abut the floor and the handle 4 is thereupon pressed downwardly so that the outer portions 5 of the sections move apart as a result of pivotal movement of the inner portions of the sections 9, 9*a* about the axes of the respective pintles 8. Pivoting of the sections 9 and 9*a* away from the second position or third position can be promoted by rapidly turning the handle 4 about its axis so that the outer portions 5 of the sections tend to move away from each other under the action of centrifugal force before the outer portions 5 are caused to contact the ground and the handle 4 is pushed downwardly to ensure that the pivotal movements of the sections continue until the end portions of the bolt 14 are again free to penetrate into the sockets 20 and 20*a*. At least some pivoting of the sections 9 and 9*a* under the action of centrifugal force (as a result of turning of the handle 4 about its axles) is assisted if the two sets of pintles 8 are not immediately adjacent each other. As mentioned above, the distance between the axes of the two sets of pintles 8 can exceed the thickness of the section 9 or 9*a* and can equal or approximate the combined thickness of the two sections.

Pivoting of the section 9 to its first or operative position is terminated by the support 7 because the latter abuts the adjacent upper surface of the section 9 when this section reaches the position of FIG. 2 or 3. Pivoting of the section 9*a* toward the operative position is terminated when the claw 27 overlies the adjacent and portion 19*a* of the locking bolt 14. During movement toward such position, the claw 27 slides along the cam face 34 and thereby pushes the bolt 14 to introduce the end portion 19 into the socket 20.

FIG. 3 shows that the end portion 19 can enter the adjacent socket 20 (to thereby lock the section 9 in the first position) before the section 9*a* reassumes the first position. In fact, the claw 27 can push the locking bolt 14 beyond the operative position which is shown in FIG. 2 in that the end portion 19 penetrates into the socket 20 to assume the left-hand end position which is indicated in FIG. 3 by broken lines 22 is then free to dissipate some energy as soon as claw 27 advances beyond the end portion 19*a* so that bolt 14 is pushed to the right and assumes the operative position of FIG. 2 as soon as the end portion 19*a* engages the adjacent side of the stop 21 and is overlapped by the claw 27.

It will be noted that return movement of the sections 9 and 9*a* to the first position of FIG. 2 does not necessitate any pivoting and/or other manipulation of the actuator 12. All that is necessary is to cause the sections 9, 9*a* to move their outer portions 5 away from each other under the action of centrifugal force and/or mechanically by causing the outer portions 5 to bear against the floor. The locking bolt 14 is automatically returned to the operative position of FIG. 2 as soon as the pivoting of the sections 9, 9*a* into or close to a common plane is completed.

A selection mechanism 102 is disposed on the carrier 2 of this invention. The selection mechanism 102 provides two orientations. The first orientation of the selection mechanism 102 allows the sections 9, 9*a* to enter the third position (in which the sections 9, 9*a* are substantially coplanar). The second orientation of the selection mechanism allows the sections 9, 9*a* to enter the second position (in which the sections 9, 9*a* are angularly disposed a distance apart).

Figure 7:
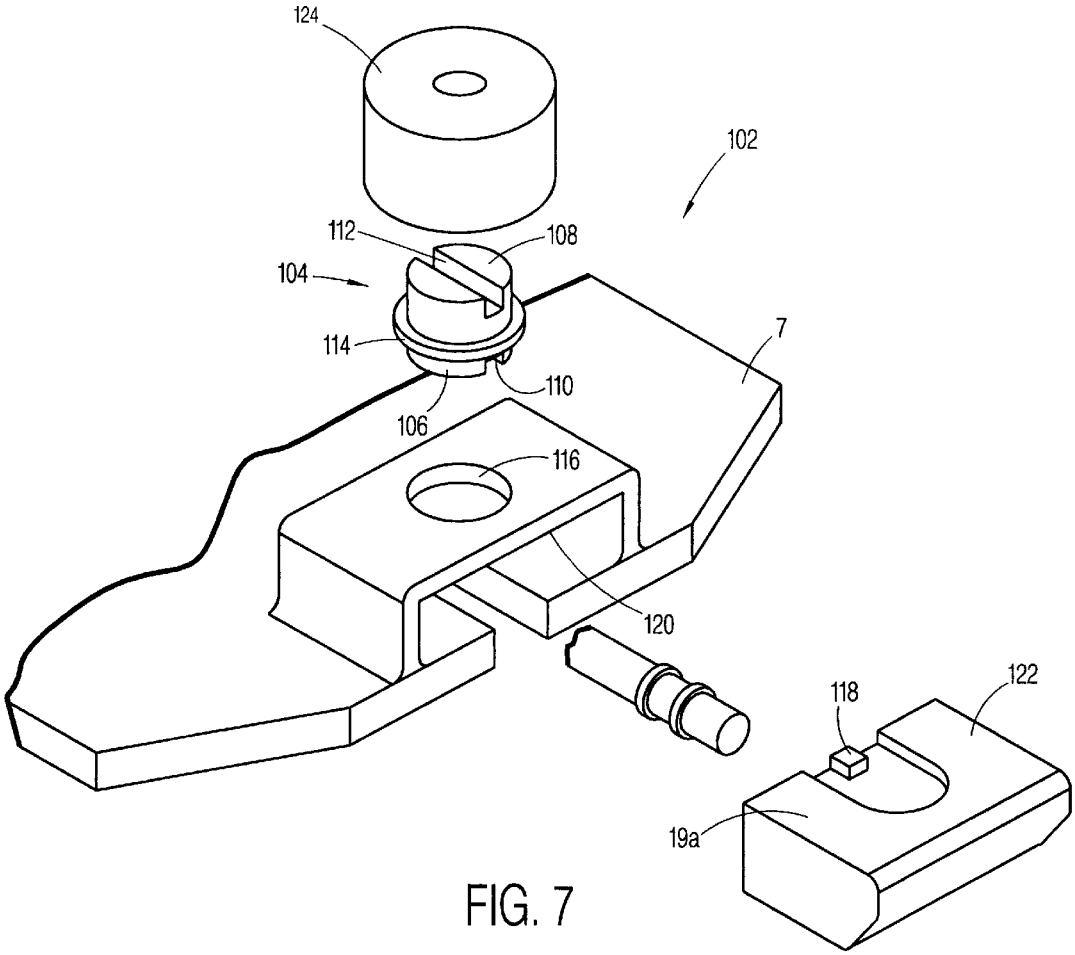
FIG. 7 is a fragmentary perspective view of the selection mechanism of the cleaning implement.

In a preferred embodiment, the selection mechanism 102 includes a post 104 having a first end portion 106 and a second end portion 108. The first end portion 106 includes a first slot 110 and the second end portion 108 includes a second slot 112. In one embodiment, as seen in FIG. 7, the post may be fitted with a cap 124. The cap 124 is secured in place with a member, not shown, that is receivable in the second slot 112 of the post 104. Further, the post 104 includes a lip portion 114 circumferentially around the post 104. However, securement may be achieved with other various mechanisms which are well known in the art. The post 104 is inserted through an opening 116 on the support 7 such that the lip portion 114 abuts an inner surface 120 of the support 7 thus preventing the post 104 from being removed from the opening 116. The selection mechanism 102 further includes a nub 118 disposed on an upper surface 122 of the locking bolt 14. In a preferred embodiment of this invention, as seen in FIG. 7, the nub 118 is disposed on the end portion 19*a* of the locking bolt 14. The nub 118 extends into the first slot 110 on the post 104.

In the first orientation, the post 104 is substantially perpendicular to the direction of the travel of the locking bolt 14. In the second orientation, the selection mechanism 102 is substantially parallel to the direction of travel of the locking bolt 14. Accordingly, the motion of the locking bolt 14 is unrestrained by the post 104. Accordingly, the nub 118 bears upon a side wall of the first slot 110 such that the motion of the locking bolt 14 is restrained with the end portion 19*a* of the locking bolt 14 distanced from the stop 21. The section 9 is therefore restrained in the socket 20 while section 9*a* is released.

In the second orientation, the sections 9, 9*a* are angularly disposed a distance apart with an angle between the sections of about 0 degrees and 180 degrees. Preferably, as seen in FIG. 7, the sections 9, 9*a* are restrained at an angle of approximately 90 degrees relative to each other. However, other various angles between the sections 9, 9*a* would also be capable of achieving the novel aspects of this invention.

If the first orientation of the selection mechanism 102 is chosen, the actuator 12, when actuated, causes or permits the sections 9, 9*a* to leave the first position and to enter the third position. The end portion 19 is retained in the socket 20. Furthermore, the end portion 19*a* is located externally of the respective bearing portion 16 of the support 7 (FIG. 4).

Alternatively, once the second orientation of the selection mechanism is chosen, the actuator 12, when actuated, causes the end portion 19 to be withdrawn from the socket 20 into the adjacent bearing portion 16 of the support 7 (FIG. 3). The end portion 19*a* is then located externally of and overlies the socket 20*a* on the actuator 12. Furthermore, the end portion 19*a* is located externally of the respective bearing portion 16 of the support 7. When in the second orientation of the selection mechanism 102, the actuator 12 causes or permits end portion 19*a* to be urged out of contact with stop 21. The end portion 19*a* is thus located externally of and overlies the socket 20*a* on the actuator 12.

The cleaning implement 1 of this invention includes a connection device 38 so that the cleaning implement 1 can be used with mopheads 6 having flaps 33 as well as with mopheads having pockets 100, 100*a*. The mophead 6 is elongated and the flap-shaped end portions 33 (hereinafter flaps) are provided at its longitudinal ends. Each of these flaps can be separably connected to the outer portion 5 of the respective section 9, 9*a* by a connecting device 38 having a substantially U-shaped pivotable yoke 39 which is movable between a retaining position (note the right-hand yoke 39 of FIG. 1) and a releasing position (note the left-hand yoke 39 of FIG. 1). Each yoke 39 comprises an elongated web 42 which is substantially parallel with the axes of the pintles 8 and two legs 50. The upper sides of outer portions 5 of the sections 9 and 9*a* are formed with U-shaped marginal recesses 41 which can receive the respective yokes 39 in the retaining positions. The yokes 39 are secured in retraining positions by rotary knobs 44 which are mounted at the upper sides of the respective sections 9, 9*a*.

Each web 42 is formed with a longitudinally extending recess 45, e.g. a recess in the form of a through slot which can receive a complementary elongated projection (e.g., a rib) 46 at the upper surface of the respective outer portion 5. Each flap 33 of the mophead 6 is caused to overlie the respective projection 46 and extends along the inner side of the respective web 42 before the yoke 39 is pivoted to the retaining position so that the flaps 33 assume an undulate shape and are reliably but readily separably connected to the respective outer portions 5. Additional connecting or retaining action can be achieved by causing the rotary knobs 44 to overlie portions of the flaps 33 (see FIG. 5). The inner sides 42*a* of the webs 42 cooperate with and can frictionally engage elongated shoulders 43 in the respective U-shaped recesses 41 when the yokes 39 are pivoted to their retaining positions in the absence of flaps 33 between such shoulders 43 and the respective inner sides. This ensures that the webs 42 of the yokes 39 frictionally engage and hold the flaps 33 in cooperation with the adjacent shoulders 43 when the mophead 6 is properly connected to the carrier 2. The just described mode of separably connecting the flaps 33 to the respective outer portions 5 by means of the connecting devices 38 ensures the establishment of a reliable connecting action even if the mophead 6 is subjected to a pronounced pulling or detaching force, e.g., in the course of the wringing operation. The width of the flaps 33 may but need not match the length of the shoulders 43, inner sides 42*a* and slots 45. Reliable clamping of the flaps 33 (each of which is provided with several undulations when the respective yoke 39 is received in its recess 41) is desirable and advantageous because the median or major portion of the mophead 6 is not positively connected to the adjacent portions of the sections 9 and 9*a*. The tensional stress upon the properly connected mophead 6 is preferably sufficient to prevent any wrinkling and/or other undesirable movements of the median portion of the mophead when the mop 1 is in actual use.

In order to prevent deformation of the yokes 39 when a mophead 6 having relatively thin flaps 33 is replaced with a mophead having thicker flaps, the upper sides of outer portions 5 of the sections 9, 9*a* are preferably provided male positioning members 48 which can enter female positioning members 49 in the legs 50 when the yokes 39 are pivoted to enter the respective recesses 41. This prevents the legs 50 of a yoke 39 from moving apart during pivoting of the yoke to its retaining position. The positions of the male and female positioning elements 48, 49 can be reversed, i.e., the male positioning elements can be provided on the legs 50 to enter female positioning elements at the upper surfaces of outer portions 5 of the respective sections 9 and 9*a*.

An important advantage of the improved mop 1 is that a single locking device 11 (i.e., a device having a single locking bolt 14) suffices to maintain the sections 9, 9*a* of the carrier 2 in the first position. Accordingly, the user of this invention need not manipulate several different devices in order to adjust the cleaning implement. Instead, the user need only operate a single actuator 12.

Another important advantage of the improved mop is that a single actuator 12 suffices to actuate the locking device 11 such that the sections 9, 9*a* are pivotable between a first position, a second position, and a third position. Furthermore, the locking bolt 14 automatically locks the sections 9, 9*a* in the first position as soon as the sections, 9, 9*a* returned substantially coplanar to the positions of FIG. 2 provided, of course, that the actuator 12 is not caused to leave the normal or starting position of FIG. 2. It has been found that the locking device 11 can maintain the sections 9, 9*a* in the first position even if the sections are subjected to the action of a large force which tends to move them toward the second or third positions. Such movement is possible only upon pivoting of the pedal 26 of the actuator 12 about the axis of the hinge 29. Reliable retention of the sections 9, 9*a* in their operative positions is of considerable advantage, particularly when the mop 1 is in actual use, because the operator need not be concerned with the possibility of accidentally releasing the locking device 11 at an inopportune time, e.g., when the carrier 2 accidentally strikes a stair or another protuberance of or an obstruction on the floor. The operator need not search for a particular actuator 12 because only one such actuator 12 is needed and provided and because the only actuator 12 is always within sight of the person holding the handle 4.

Yet, another advantage of this invention is that a selection mechanism 102 allows the user to select whether the sections enter the second position or the third position. Accordingly, the cleaning implement 1 of this invention is far more versatile than other conventional cleaning implements. Namely, the user can operate the above invention with mopheads 6 that are attached with flaps 33 or with pockets 100, 100*a*. When inserting a new mophead 6 having pockets 100, 100*a*, the user will lay the mophead 6 on the floor. Next, the user will verify that the selection mechanism 102 is set to the first orientation. Accordingly, when the user depresses pedal 26, the end portion 19*a* is released from socket 20*a*. However, end portion 19 is retained within the socket 20. With the end portion 19 retained and end portion 19*a* released, the sections 9, 9*a* are in the third position. As seen in FIG. 4, the sections are angularly disposed a distance apart at an angle between 0 degrees and 180 degrees. Preferably, the angle between the sections is approximately 90 degrees. Once in the third position, each of the sections 9, 9*a* can be placed adjacent a respective pocket 100, 100*a*.

To assemble the cleaning implement 1, the user simply presses the carrier 2 towards the mophead 6. As best appreciated by one skilled in the art, the sections 9, 9*a* are slid away from one another towards the first position. This result is achieved because the sections 9, 9*a* are retained at an angle apart. If the sections 9, 9*a* were in the second position (substantially confronting) the sections 9, 9*a* would be unable to slide into the pockets 100, 100*a* as they do when in the third position. In the second position, pressure applied to the sections is translated along a longitudinal axis of the sections 9, 9*a*. Accordingly, the sections 9, 9*a* will not slide since no substantial portion of the force applied is translated in a direction parallel to the ground. Alternatively, the operator may use the cleaning implement 1 of this invention with mopheads 6 having flaps 33. To do so, the operator must merely set the selection mechanism 102 to the first orientation. Once the actuator 12 is actuated, the sections 9, 9*a* will enter the second position in which the sections are substantially coplanar.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

The embodiments of the invention on which an exclusive property or privilege is claimed are defined as follows:

1. A cleaning implement comprising:

a carrier including a first section and a second section, each said section having an upper surface and a lower surface, each said section being pivotable about a respective pivot axis, said sections being pivotable relative to each other between a first position in which said lower surfaces are substantially coplanar a second position in which said lower surfaces substantially confront each other and a third position in which said lower surfaces are retained at an angle between said first position and said second position;

a locking device for releasably locking both said sections in said first position, said locking device including a bolt which is reciprocable along a predetermined path substantially transversely of said pivot axes, said bolt having a first end portion and a second end portion; said locking device further including first and second sockets disposed on a corresponding upper surface of the respective sections; and selection means associated with said locking device, said selection means being adapted to select between said second position and said third position.

2. A cleaning implement as recited in claim 1, wherein said angle between said sections is approximately between 0 degrees and 180 degrees when in said third position.

3. A cleaning implement as recited in claim 1, wherein said angle between said sections is approximately 90 degrees when in said third position.

4. A cleaning implement as recited in claim 1, wherein said cleaning implement further comprises:

a handle; and means for movably coupling disposed between said handle and said carrier.

5. A cleaning implement as recited in claim 4, wherein said locking device further includes an actuator, said actuator including a claw and a pivotable pedal.

6. A cleaning implement as recited in claim 5, wherein said selection means further comprises:

a support having an opening disposed on said carrier;

a post having a first slot disposed at a first end, said post being receivable in said opening, said post being moveable between a first orientation and a second orientation; and a nub disposed on said locking bolt, said nub being in communication with said slot such that said post is rotatable between a first orientation and a second orientation, said slot being transverse to the motion of said bolt such that said bolt is retained in position when said post is in said first orientation, and said slot is parallel with said motion of said bolt such that the bolt is released into another position when said post is in said second orientation.

7. A cleaning implement as recited in claim 6, wherein said support includes an upper surface and a lower surface, and said post includes a lip abutting said lower surface such that said post is rotatably secured to said support.

8. A cleaning implement comprising:

a carrier including a first section and a second section each having an upper surface and a lower surface, said sections being pivotable relative to each other between a first position in which said lower surfaces are substantially coplanar a second position in which said lower surfaces substantially confront each other and a third position in which said lower surfaces are angularly disposed a distance apart relative to each other;

a handle;

means for movably coupling said handle to said carrier at the upper surfaces of said sections, said carrier further comprising a support for said coupling means and hinges pivotably connecting said sections to said support, said support overlying portions of said upper surfaces in the first position of said sections and said hinges defining substantially parallel pivot axes for said sections;

means for releasably locking said sections in said first position, said means for releasably locking including a locking device which is actuatable to release said sections for movement from said first position; said locking device comprising a bolt which is reciprocable along a predetermined path substantially transversely of said pivot axes and has first and second end portions, and first and second sockets provided at the upper surfaces of the respective sections and spaced apart from said hinges, said locking bolt being retained in a first position in which said first end portion and said second end portion are received in respective sockets a second position in which said first end portion and said second end portion are withdrawn from the respective sockets and a third position in which one of said end portions is withdrawn from the respective socket, said locking device further comprising means for biasing said locking bolt into said first position and means for blocking the movement of said bolt beyond said second position under the action of said biasing means;

an actuator associated with said locking device, said actuator being movable between a retaining position in which at least one of said sockets is free to receive the respective end portion of said locking bolt and a releasing position in which at least one of said sockets is outside of the path of movement of the respective end portion;

means for moving said locking bolt from said second position in response to pivoting of the sections to said first position; and selection means associated with said locking device, said selection means being adapted to select between said second position and said third position.

9. A cleaning implement as recited in claim 8, wherein said angle between said sections is between approximately 0 degrees and 180 degrees when in said third position.

10. A cleaning implement as recited in claim 9, wherein said angle is approximately 90 degrees when in said third position.

11. A cleaning implement as recited in claim 8, wherein said selection means further comprises:

a support having an opening disposed on said carrier;

a post having a first slot disposed at a first end and a second slot disposed at a second end, said post being receivable in said opening; and a nub disposed on said locking bolt, said nub being in communication with said slot such that said post is rotatable between a first orientation and a second orientation, said slot being transverse to the motion of said bolt such that said bolt is retained in said third position when said post is in said first orientation, and said slot is parallel with said motion of said bolt such that the bolt is releasable into said second position when said post is in said second orientation.

12. A cleaning implement as recited in claim 11, wherein said support includes an upper surface and a lower surface, and said post includes a lip abutting said lower surface such that said post is rotatably secured to said carrier.

13. The cleaning implement of claim 8, wherein said moving means comprises at least one cam face confronting at least one socket.

14. The cleaning implement of claim 13, wherein said actuator includes a claw forming part of said at least one socket, and a pedal adjacent said claw.

15. The cleaning implement of claim 14, wherein said claw engages said cam face to move said locking bolt from said second position in response to pivoting of the section for said actuator to said first position.

16. The cleaning implement of claim 15, wherein said support comprises a guide for said locking bolt.

17. The cleaning implement of claim 16, wherein said guide forms part of said coupling means.

18. A cleaning implement comprising:

a carrier including first and second sections each having an upper surface and a lower surface, said sections being pivotable relative to each other between a first position in which said lower surfaces are substantially coplanar a second position in which said lower surfaces confront each other and a third position where said sections are angularly disposed at an angle of approximately 90 degrees apart relative to each other, said carrier further comprising a support and hinges pivotably connecting said sections to said support, said support overlying portions of said upper surfaces in the first positions of said sections and said hinges defining substantially parallel pivot axes for said sections;

a handle;

means for movably coupling said handle to said carrier at the upper surfaces of said sections;

a locking device which is actuatable to release said sections for movement from said first position and a single actuator for said locking device, said locking device comprising a locking bolt which is reciprocable along a predetermined path substantially transversely of said pivot axes and has first and second end portions, said locking device further comprising first and second sockets provided at the upper surfaces of the respective sections and spaced apart from said hinges, said locking bolt being retained in a first position in which said first end portion and said second end portion is received in the respective sockets a second position in which both of said end portions are withdrawn from the respective sockets and a third position where one of said end portions is withdrawn removed from the respective socket, means for biasing said bolt towards said second position, and means for locating said bolt in said first position against the opposition of said biasing means; and a selection means comprising said support having an opening, a post having a first slot disposed at a first end and a second clot disposed at a second end, said post being receivable in said opening, and a nub disposed on said locking bolt, said nub being in communication with said slot such that said post is rotatable between a first orientation and a second orientation, said slot being parallel with said motion of said locking bolt such that the locking bolt is releasable into said second position when said post is in said first orientation, and said slot being transverse to the motion of said bolt such that said bolt is retained in said third position when said post is in said second orientation.

* * * * *